United States Patent [19]

Paulhus et al.

[11] Patent Number: 4,676,260

[45] Date of Patent: Jun. 30, 1987

[54] TOTAL HAIR CARE PISTOL

[76] Inventors: Dorothy A. Paulhus; George Spector, both of 233 Broadway, RM 3615, New York, N.Y. 10007

[21] Appl. No.: 555,580

[22] Filed: Nov. 28, 1983

[51] Int. Cl.[4] ..... A45D 20/00

[52] U.S. Cl. ..... 132/9; 132/112; 219/222; 219/367; 219/373; 34/98

[58] Field of Search ..... 132/9, 11 R, 112; 219/222, 226, 229, 367, 370, 373; 34/96–101

[56] References Cited

U.S. PATENT DOCUMENTS

| | | | |
|---|---|---|---|
| 2,420,732 | 5/1947 | Bichsel et al. | 34/97 X |
| 3,610,881 | 10/1971 | Stewart | 219/370 |
| 3,937,231 | 2/1976 | Tucker et al. | 219/370 |
| 3,943,329 | 3/1976 | Hlavac | 219/370 |
| 3,990,460 | 11/1976 | Shalvoy | 132/9 |
| 4,197,448 | 4/1980 | Harigai | 219/367 |
| 4,316,077 | 2/1982 | Carlson | 219/367 |

*Primary Examiner*—Michael H. Thaler

[57] ABSTRACT

A hair-care tool is provided and consists of a housing having a graspable handle and a barrel. The barrel having a mounting guide at an outlet at one end thereof and an attachment having a built-in heating element and electrical contacts. End of the attachment mates within the mounting guide in the barrel forming an electrical contact with a heat switch so that the heat switch can control the heating element within the attachment.

2 Claims, 7 Drawing Figures

TOTAL HAIR CARE PISTOL

BACKGROUND OF THE INVENTION

The instant invention relates generally to hair dryers and more specifically it relates to a hair-care tool.

In regular hair dryers the heating element is built into the housing. If this heating element burns out or malfunctions the hair dryer will become useless. This situation is not desirable so accordingly it is in need of an improvement.

Numerous hair dryers have been provided in prior art, that are adapted to dry hair. For example, U.S Pat. Nos. 3,939,850; 3,949,765 and 4,297,564, all are illustrative of such prior art. While these units may be suitable for the particular purpose to which they address, they would not be as suitable for the purposes of the present invention as heretofore described.

SUMMARY OF THE INVENTION

A principle object of the present invention is to provide a hair-care tool that has a built-in heating element within the attachment.

Another object is to provide a hair-care tool that utilizes several attachments for grooming hair.

An additional object is to provide a hair-care tool wherein each attachment is designed to perform a specific function on the hair.

A further object is to provide a hair-care tool that is simple and easy to use.

A still further object is to provide a hair-care tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
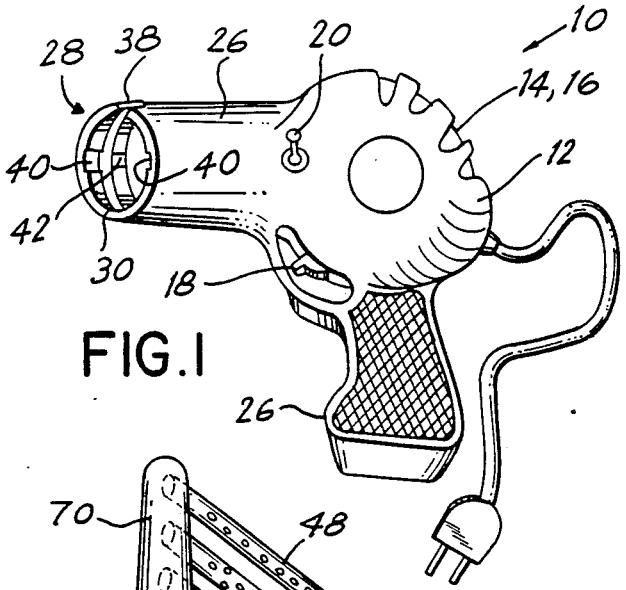
FIG. 1 is a perspective view of the handle of the invention.
Figure 4:
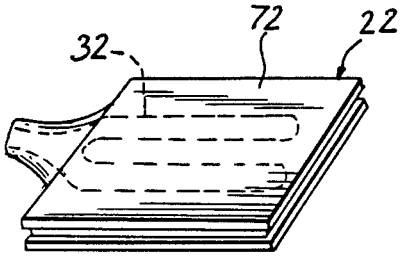
FIG. 4 is a perspective view of another attachment showing heat element within.
Figure 2:
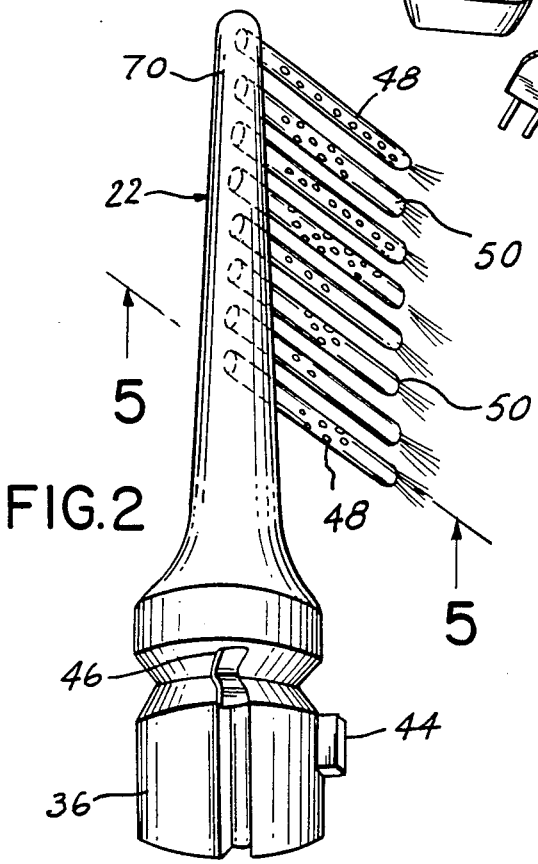
FIG. 2 is an enlarged perspective view of one of the attachment of the invention.

Turning now descriptively to the drawings, in which similar reference characters denote similar elements throughout the several views, FIGS. 1, 2 and 4 illustrates a hair-care tool 10. The hair-care tool 10 consists of a housing 12, a fan 14, a motor 16, a variable switch trigger 18, a heat switch 20 and an attachment 22.

The housing 12 has a graspable handle 24 and a barrel 26. The handle 24 is readily capable of being held with one hand of an operator and the barrel 26 has a mounting guide 28 at an outlet 30 at one end thereof.

The motor 16 is for driving the fan 14 and is contained within the housing 12 for projecting air therethrough and discharging air through the outlet 30 of the barrel 26.

The variable switch trigger 18 is mounted in the handle 24 of the housing 12 to control speed of the air therethrough by a finger of the hand of the operator. The heat switch 20 is mounted in the housing 12 in proximity to the variable switch trigger 18.

Each attachment 22 has a built-in heating element 32 embedded therein and electrical contacts 46. The end 36 of each attachment 22 (See FIG. 2) mates within the mounting guide 28 in the barrel 26 forming an electrical contact with the heat switch 20; which is electrically connected with contacts in guide 28. The heat switch 20 controls the heating element 32 within each attachment 22 while the fan 14 is positioned to drive air across the heating element 32 in each attachment 22.

The mounting guide 28 further consists of a keyway 38 and a pair of slots 40 having copper contacts 42, electrically connected to switch 20, which will only accept the attachment 22 when properly oriented. The circuit is completed when the attachment 22 is fully seated in the barrel 26. Each attachemnt 22 further consists of a guide member 44 that mates with the keyway 38 and a pair of electrical spring contacts 46 that slide within the slots 40. Accordingly, when spring contacts 46 are seated in slots 40, electric contact is made with contacts 42 thus providing current to heating element 32 upon switch closure.

As shown in FIG. 2 the attachment 22 can have a plurality of apertures 48 to allow the air to exit from the attachment 22 via spines 50.

Figure 5:
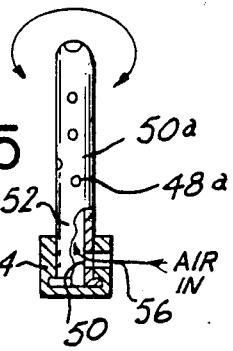
FIG. 5 is a cross sectional view taken along line 5—5 in FIG. 2 showing a modified rotatable comb tooth.

As shown in FIG. 5 the attachment 22 can have a plurality of rotatable spines **50*a*. Each spine 50*a* has a plurality of apertures 48*a*. The spine 50*a* can be turned at bottom 52 in a container 54 that has an aperture 56 that is in alignment with an aperture 58 in the bottom 52 to control air flow through the attachment 22**.

Figure 6:
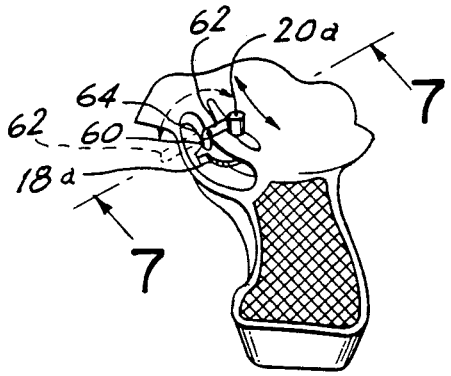
FIG. 6 is a partial perspective view of a modified handle showing the variable speed switch cooperating with the heat switch.
Figure 7:
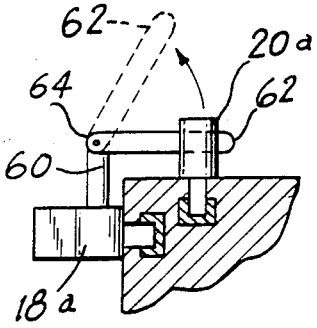
FIG. 7 is a cross sectional view taken along line 7—7 in FIG. 6.

In FIGS. 6 and 7 the heat switch **20*a* is mechanically connected to the variable switch trigger 18*a*. A vertical arm 60 is mounted to the variable switch trigger 18*a* and a horizontal arm 62 is pivotally connected at 64 to the vertical arm 60. The horizontal arm 62 can pivot down to contact the heat switch 20*a* so that when the variable switch trigger 18*a* is activated the heat switch 20*a*** is also activated.

Figure 3:
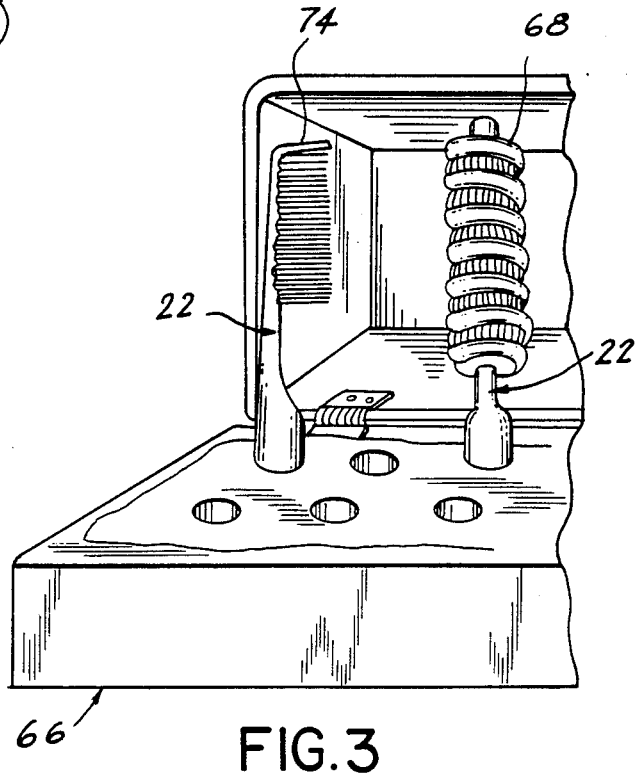
FIG. 3 is a partial perspective view of an attachment case.

FIG. 3 shows an attachment case 66 to hold the various attachments 22. The various attachments 22 can be a spiral iron 68, a rack or pick 70, a crimper (not shown), a wave plate 72, a curling iron (not shown), a roller (not shown), wave clamps (not shown), a comb 74, a straightener (not shown), air flow diffuser (not shown) and a curling iron with bristles (not shown). All of the above attachments have built-in heating elements 32 as shown in FIG. 4.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A hair care tool which comprises:

(a) a housing having a handle and a barrel, said handle readily capable of being held with one hand of an operator and said barrel having a mounting guide at an outlet at one end thereof;

(b) means contained within said housing for projecting air therethrough and discharging air through said outlet of said barrel;

(c) a variable switch trigger mounted in said handle of said housing to control speed of said air therethrough by a finger of said hand of said operator;

(d) a heat switch connected to electrical contacts mounted in said housing in proximity to said variable switch trigger; and (e) an attachment having a heating element embedded therein and electrical contacts electrically connected to said element whereby said attachment mates within said mounting guide in said barrel to provide electrical connection between said contacts in said housing and said contacts on said attachment whereby current will be supplied to said element upon switch actuation, wherein said mounting guide further consists of a keyway and a pair of slots having electrical contacts which will only accept said attachment when properly oriented so that electrical connection is made between said attachment and guide contacts when said attachment is fully seated in said barrel, wherein said attachment further consists of a guide member that mates with said keyway and a pair of electric spring contacts that slide within said slots to engage said guide member electrical contacts, wherein said means includes a fan and a motor for driving said fan, said fan being positioned to drive air across said heating element in said attachment, wherein said attachment has a plurality of apertures to allow said air to exit from said attachment, wherein said attachment has a plurality of rotatable spines having means for adjusting amount of air flow, a plurality of outlet apertures so that said spines can be turned to control amount of air flow through said attachment and said spines.

2. A hair care tool as recited in claim 1 wherein said heat switch is mechanically connected to said variable switch trigger via a vertical arm mounted to said variable switch trigger and a horizontal arm which can pivot down to engage said heat switch so that when said variable switch trigger is activated said heat switch is also activated.

* * * * *